US008598806B2

(12) United States Patent
Li et al.

(10) Patent No.: US 8,598,806 B2
(45) Date of Patent: Dec. 3, 2013

(54) SYSTEMS AND METHODS FOR INTELLIGENT CONTROL OF COLD-CATHODE FLUORESCENT LAMPS

(75) Inventors: Miao Li, Shanghai (CN); Liqiang Zhu, Shanghai (CN); Jun Zhou, Shanghai (CN); Lieyi Fang, Shanghai (CN)

(73) Assignee: On-Bright Electronics (Shanghai) Co., Ltd., Shanghai (CN)

( * ) Notice: Subject to any disclaimer, the term of this patent is extended or adjusted under 35 U.S.C. 154(b) by 119 days.

(21) Appl. No.: 13/335,092

(22) Filed: Dec. 22, 2011

(65) Prior Publication Data

US 2012/0326629 A1 Dec. 27, 2012

Related U.S. Application Data

(60) Provisional application No. 61/430,499, filed on Jan. 6, 2011.

(51) Int. Cl.
*H05B 41/36* (2006.01)

(52) U.S. Cl.
USPC ..... 315/291

(58) Field of Classification Search
USPC ..... 315/291, 224, 246, 247, 293, 294, 295, 315/297, 307, 312, 314, DIG. 4
See application file for complete search history.

(56) References Cited

U.S. PATENT DOCUMENTS

| | | | | |
|---|---|---|---|---|
| 7,414,371 | B1 * | 8/2008 | Choi et al. | 315/291 |
| 7,515,445 | B2 * | 4/2009 | Lin | 363/98 |
| 7,515,446 | B2 * | 4/2009 | Lin | 363/98 |

* cited by examiner

*Primary Examiner* — Minh D A
(74) *Attorney, Agent, or Firm* — Jones Day

(57) ABSTRACT

System and method for driving one or more cold-cathode fluorescent lamps. For example, the method includes generating at least one drive signal associated with a signal frequency, the signal frequency being equal to a first predetermined frequency, receiving a current-sensing signal, the current-sensing signal being associated with a lamp current for the one or more cold-cathode fluorescent lamps in response to at least the first predetermined frequency, and determining whether the current-sensing signal is larger than a first threshold in magnitude, the current-sensing signal being related to the first predetermined frequency. Additionally, the method includes, if the current-sensing signal related to the first predetermined frequency is determined to be larger than the first threshold in magnitude at anytime during a first period of time, changing the signal frequency from the first predetermined frequency to a second predetermined frequency, the second predetermined frequency being different from the first predetermined frequency.

20 Claims, 9 Drawing Sheets

SYSTEMS AND METHODS FOR INTELLIGENT CONTROL OF COLD-CATHODE FLUORESCENT LAMPS

1. CROSS-REFERENCES TO RELATED APPLICATIONS

This application claims priority to U.S. Provisional Application No. 61/430,499, filed Jan. 6, 2011, commonly assigned and incorporated by reference herein for all purposes.

2. BACKGROUND OF THE INVENTION

The present invention is directed to integrated circuits. More particularly, the invention provides systems and methods for driving cold-cathode fluorescent lamps (CCFLs). Merely by way of example, the invention has been applied to intelligent control of one or more CCFLs. But it would be recognized that the invention has a much broader range of applicability.

Cold-cathode fluorescent lamps (CCFLs) are widely used for backlighting of thin-film-transistor (TFT) liquid-crystal displays (LCDs), such as television displays, computer displays, portable DVD displays, global positioning system (GPS) displays, handheld video-game console displays, and industrial instrument displays. The CCFLs often each include a sealed glass tube that contains one or more inert gases, such as Neon (Ne) and Argon (Ar) gases, which are also mixed with certain amount of mercury (Hg) vapor. Additionally, the sealed glass tube usually is internally covered by one or more fluorescent materials. If a high-magnitude and high-frequency AC voltage is applied to a cold-cathode fluorescent lamp (CCFL), the mercury vapor can be excited by the electric field, thus causing the CCFL to emit light.

FIG. 1 is a simplified diagram showing a conventional control system for one or more CCFLs. The control system 100 includes a power train component 110, a current/voltage feedback component 120, a controller chip 130, and a dimming-control interface 134. The controller chip 130 receives a dimming-control signal 135 from the dimming-control interface 134, and in response generates one or more gate drive signals 112. The power train component 110 receives the gate drive signals 112, and in response converts a direct-current (DC) voltage 114 generated from a DC power supply 136 to an alternating-current (AC) voltage 116. For example, the power train component 110 uses a voltage boost transformer and a resonant LC network to generate the AC voltage 116. The AC voltage 116 that is applied to the one or more CCFLs 132 is converted to a voltage-sensing signal 124 (e.g., $V_{vs}$) by the current/voltage feedback component 120. The voltage-sensing signal 124 is received by the controller chip 130, which generates the gate drive signals 112 and regulates the AC voltage 116 to a predetermined magnitude and a predetermined frequency. For example, the AC voltage 116 corresponds to different predetermined magnitudes and/or different predetermined frequencies for an ignition operation and a normal operation of the control system 100. As an example, the controller chip 130 includes an error amplifier. In another example, an output signal, $V_{cmp}$, of the error amplifier is used to determine a duty cycle of the gate drive signals 112 and thus the power transmitted to the one or more CCFLs 132. In yet another example, if the output signal, $V_{cmp}$, becomes higher, the power transmitted to the one or more CCFLs 132 also becomes higher.

As shown in FIG. 1, a current that flows through the one or more CCFLs 132 is also converted to a current-sensing signal 122 (e.g., $V_{cs}$) by the current/voltage feedback component 120. For example, the current/voltage feedback component 120 includes a current sensing resistor. In another example, the current-sensing signal 122 (e.g., $V_{cs}$) is also received by the controller chip 130 and compared with a first threshold (e.g., $V_{th1}$). In yet another example, if the current-sensing signal 122 (e.g., $V_{cs}$) becomes larger than the first threshold (e.g., $V_{th1}$), the control system 100 switches from the ignition operation to the normal operation. If the current-sensing signal 122 (e.g., $V_{cs}$) has not yet become larger than the first threshold (e.g., $V_{th1}$) but the voltage-sensing signal 124 (e.g., $V_{vs}$) is larger than a second threshold (e.g., $V_{th2}$) and/or the output signal $V_{cmp}$ is larger than a third threshold (e.g., $V_{th3}$), the control system 100 keeps checking the current that flows through the one or more CCFLs 132 for a first predetermined period of time (e.g., $T_1$).

If, during the first predetermined period of time (e.g., $T_1$), the current-sensing signal 122 (e.g., $V_{cs}$) becomes larger than the first threshold (e.g., $V_{th1}$), the control system 100 switches from the ignition operation to the normal operation. If, during the first predetermined period of time (e.g., $T_1$), the current-sensing signal 122 (e.g., $V_{cs}$) remains smaller than the first threshold (e.g., $V_{th1}$), the control system 100 shuts down the output of the AC voltage 116.

For example, the current that flows through the one or more CCFLs 132 after successful ignition is determined as follows:

$$I_{CCFL} = V_{in} \times N \times \frac{2}{\pi} \times \sin\left(\frac{\pi}{2}D\right) \times \left|\frac{1}{R - 4\pi^2 RCLf^2 + j2\pi fL}\right| \quad \text{(Equation 1)}$$

where $I_{CCFL}$ represents the current that flows through the one or more CCFLs 132 after successful ignition. Additionally, $V_{in}$ represents the magnitude of the DC voltage 114, and f represents the frequency of the AC voltage 116. Moreover, C represents the parasitic capacitance of the one or more CCFLs 132. Also, N, D, R, and L are constant parameters that are determined by the control system 100.

As discussed above, the AC voltage 116 can change in magnitude and/or in frequency if the control system 100 switches from the ignition operation to the normal operation. For example, the ignition of the one or more CCFLs 132 often needs the AC voltage 116 to be about 1000 volts in magnitude, but the normal operation of the one or more CCFLs 132 usually needs a much smaller magnitude for the AC voltage 116. In another example, each of the one or more CCFLs 132 has a high resistance level of about 10 MΩ before ignition but a much lower resistance level of about 200 KΩ at normal operation after successful ignition.

Also, as discussed above, the power train component 110 uses the voltage boost transformer and the resonant LC network to generate the AC voltage 116. For the resonant LC network, the voltage gain as a function of the voltage frequency often changes if the one or more CCFLs are successfully ignited.

FIG. 2(A) is a simplified diagram showing a conventional voltage gain of the resonant LC network used by the power train component 110 before successful ignition of a CCFL. As shown in FIG. 2(A), a waveform 200 represents the voltage gain of the resonant LC network as a function of voltage frequency. For example, the voltage gain reaches a peak value 202 at a resonant frequency 208 as shown by the waveform 200. In another example, the resonant frequency 208 is about 60 kHz.

FIG. 2(B) is a simplified diagram showing a conventional voltage gain of the resonant LC network used by the power train component 110 after successful ignition of the CCFL.

As shown in FIG. 2(B), a waveform 204 represents the voltage gain of the resonant LC network as a function of voltage frequency. For example, the voltage gain reaches a peak value 206 at a resonant frequency 210 as shown by the waveform 204. In another example, the resonant frequency 210 is less than 50 kHz.

As shown in FIGS. 2(A) and 2(B), the resonant frequency 208 before successful ignition of the CCFL is significantly higher than the resonant frequency 210 after successful ignition of the CCFL (e.g., because of different electrical characteristics of the CCFL before and after the ignition).

Returning to FIG. 1, in order for the resonant LC network to achieve a high gain for both the ignition operation and the normal operation, the control system 100 may change the voltage frequency when the control system switches from the ignition operation to the normal operation. For example, during the ignition operation, the predetermined frequency of the AC voltage 116 is set higher and then, during the normal operation, is set lower after the detection of successful ignition of the one or more CCFLs 132.

Additionally, after the control system 100 enters into the normal operation, the controller chip 130 may compare the current-sensing signal 122 (e.g., $V_{cs}$) with an open-loop threshold (e.g., $V_{th_olp}$). If the current-sensing signal 122 (e.g., $V_{cs}$) is determined to be smaller than the open-loop threshold (e.g., $V_{th_olp}$) for a predetermined open-loop period of time (e.g., $T_{olp}$), the control system 100 may trigger the open loop protection (OLP) and shuts down the output of the AC voltage 116.

But the control system 100 may not function properly under certain circumstances. Hence, it is highly desirable to improve the techniques of controlling CCFLs.

3. BRIEF SUMMARY OF THE INVENTION

The present invention is directed to integrated circuits. More particularly, the invention provides systems and methods for driving one or more CCFLs. Merely by way of example, the invention has been applied to intelligent control of one or more CCFLs. But it would be recognized that the invention has a much broader range of applicability.

According to one embodiment, a method for driving one or more cold-cathode fluorescent lamps includes generating at least one drive signal associated with a signal frequency, the signal frequency being equal to a first predetermined frequency, receiving a current-sensing signal, the current-sensing signal being associated with a lamp current for the one or more cold-cathode fluorescent lamps in response to at least the first predetermined frequency, and determining whether the current-sensing signal is larger than a first threshold in magnitude, the current-sensing signal being related to the first predetermined frequency. Additionally, the method includes, if the current-sensing signal related to the first predetermined frequency is determined to be larger than the first threshold in magnitude at anytime during a first period of time, changing the signal frequency from the first predetermined frequency to a second predetermined frequency, the second predetermined frequency being different from the first predetermined frequency. Further, the method includes, if the current-sensing signal related to the first predetermined frequency is determined to be smaller than the first threshold in magnitude throughout the first period of time, changing the signal frequency from the first predetermined frequency to a third predetermined frequency, the third predetermined frequency being different from the first predetermined frequency, generating at least the drive signal associated with the signal frequency, the signal frequency being equal to the third predetermined frequency, receiving the current-sensing signal, the current-sensing signal being associated with the lamp current in response to at least the third predetermined frequency, and determining whether the current-sensing signal is larger than the first threshold in magnitude, the current-sensing signal being related to the third predetermined frequency. Moreover, the method includes, if the current-sensing signal related to the third predetermined frequency is determined to be larger than the first threshold in magnitude at anytime during a second period of time, changing the signal frequency from the third predetermined frequency to the second predetermined frequency if the second predetermined frequency is different from the third predetermined frequency.

According to another embodiment, a method for driving one or more cold-cathode fluorescent lamps includes generating at least one drive signal associated with a signal frequency, the signal frequency being equal to a first predetermined frequency, receiving a current-sensing signal, the current-sensing signal being associated with a lamp current for the one or more cold-cathode fluorescent lamps in response to at least the first predetermined frequency, and determining whether the current-sensing signal is larger than a first threshold in magnitude, the current-sensing signal being related to the first predetermined frequency. Additionally, the method includes, if the current-sensing signal related to the first predetermined frequency is determined to be larger than the first threshold in magnitude, generating at least the drive signal related to a second predetermined frequency, the second predetermined frequency being the same as or different from the first predetermined frequency, for a first period of time, maintaining or changing at least the drive signal, not in response to whether the current-sensing signal related to the second predetermined frequency is smaller than a second threshold in magnitude, and after the first period of time, determining whether the current-sensing signal related to the second predetermined frequency is smaller than the second threshold in magnitude. The method further includes, if the current-sensing signal related to the second predetermined frequency is determined to be smaller than the second threshold in magnitude throughout a second period of time, changing the drive signal in order to turn off the one or more cold-cathode fluorescent lamps, wherein the second period of time begins no earlier than an end of the first period of time.

According to yet another embodiment, a system for driving one or more cold-cathode fluorescent lamps includes a system controller. The system controller is configured to generate at least one drive signal associated with a signal frequency, the signal frequency being equal to a first predetermined frequency, receive a current-sensing signal, the current-sensing signal being associated with a lamp current for the one or more cold-cathode fluorescent lamps in response to at least the first predetermined frequency, and determine whether the current-sensing signal is larger than a first threshold in magnitude, the current-sensing signal being related to the first predetermined frequency. In addition, the system controller is configured to, if the current-sensing signal related to the first predetermined frequency is determined to be larger than the first threshold in magnitude at anytime during a first period of time, change the signal frequency from the first predetermined frequency to a second predetermined frequency, the second predetermined frequency being different from the first predetermined frequency. Further, the system controller is configured to, if the current-sensing signal related to the first predetermined frequency is determined to be smaller than the first threshold in magnitude throughout the first period of time, change the signal frequency from the first predetermined frequency to a third predetermined frequency, the third predetermined frequency being different from the first predetermined frequency, generate at least the drive signal associated with the signal frequency, the signal frequency being equal to the third predetermined frequency, receive the current-sensing signal, the current-sensing signal being associated with the lamp current in response to at least the third predetermined frequency, and determine whether the current-sensing signal is larger than the first threshold in magnitude, the current-sensing signal being related to the third predetermined frequency. Moreover, the system controller is configured to, if the current-sensing signal related to the third predetermined frequency is determined to be larger than the first threshold in magnitude at anytime during a second period of time, change the signal frequency from the third predetermined frequency to the second predetermined frequency if the second predetermined frequency is different from the third predetermined frequency.

According to yet another embodiment, a system for driving one or more cold-cathode fluorescent lamps includes a system controller. The system controller is configured to generate at least one drive signal associated with a signal frequency, the signal frequency being equal to a first predetermined frequency, receive a current-sensing signal, the current-sensing signal being associated with a lamp current for the one or more cold-cathode fluorescent lamps in response to at least the first predetermined frequency, and determine whether the current-sensing signal is larger than a first threshold in magnitude, the current-sensing signal being related to the first predetermined frequency. Additionally, the system controller is configured to, if the current-sensing signal related to the first predetermined frequency is determined to be larger than the first threshold in magnitude, generate at least the drive signal related to a second predetermined frequency, the second predetermined frequency being the same as or different from the first predetermined frequency, for a first period of time, maintain or change at least the drive signal, not in response to whether the current-sensing signal related to the second predetermined frequency is smaller than a second threshold in magnitude, and after the first period of time, determine whether the current-sensing signal related to the second predetermined frequency is smaller than the second threshold in magnitude. Moreover, the system controller is configured to, if the current-sensing signal related to the second predetermined frequency is determined to be smaller than the second threshold in magnitude throughout a second period of time, change the drive signal in order to turn off the one or more cold-cathode fluorescent lamps, wherein the second period of time begins no earlier than an end of the first period of time.

Many benefits are achieved by way of the present invention over conventional techniques. Certain embodiments of the present invention provide an intelligent control of cold-cathode fluorescent lamps (CCFLs). Some embodiments of the present invention provide reliable transitions of CCFLs from ignition operation to normal operation. Certain embodiments of the present invention change an AC frequency from a first predetermined frequency after a first predetermined period of time to a second predetermined frequency for a second predetermined period of time during the ignition operation. Some embodiments of the present invention change an AC frequency from a first predetermined frequency after a first predetermined period of time to a third predetermined frequency and/or a second predetermined frequency for a second predetermined period of time during the ignition operation. Some embodiments of the present invention would blank or disable an open-loop protection of a control system for a third predetermined period of time after the control system switches from the ignition operation to the normal operation.

Depending upon embodiment, one or more benefits may be achieved. These benefits and various additional objects, features and advantages of the present invention can be fully appreciated with reference to the detailed description and accompanying drawings that follow.

4. BRIEF DESCRIPTION OF THE DRAWINGS

5. DETAILED DESCRIPTION OF THE INVENTION

The present invention is directed to integrated circuits. More particularly, the invention provides systems and methods for driving one or more CCFLs. Merely by way of example, the invention has been applied to intelligent control of one or more CCFLs. But it would be recognized that the invention has a much broader range of applicability.

Figure 1:
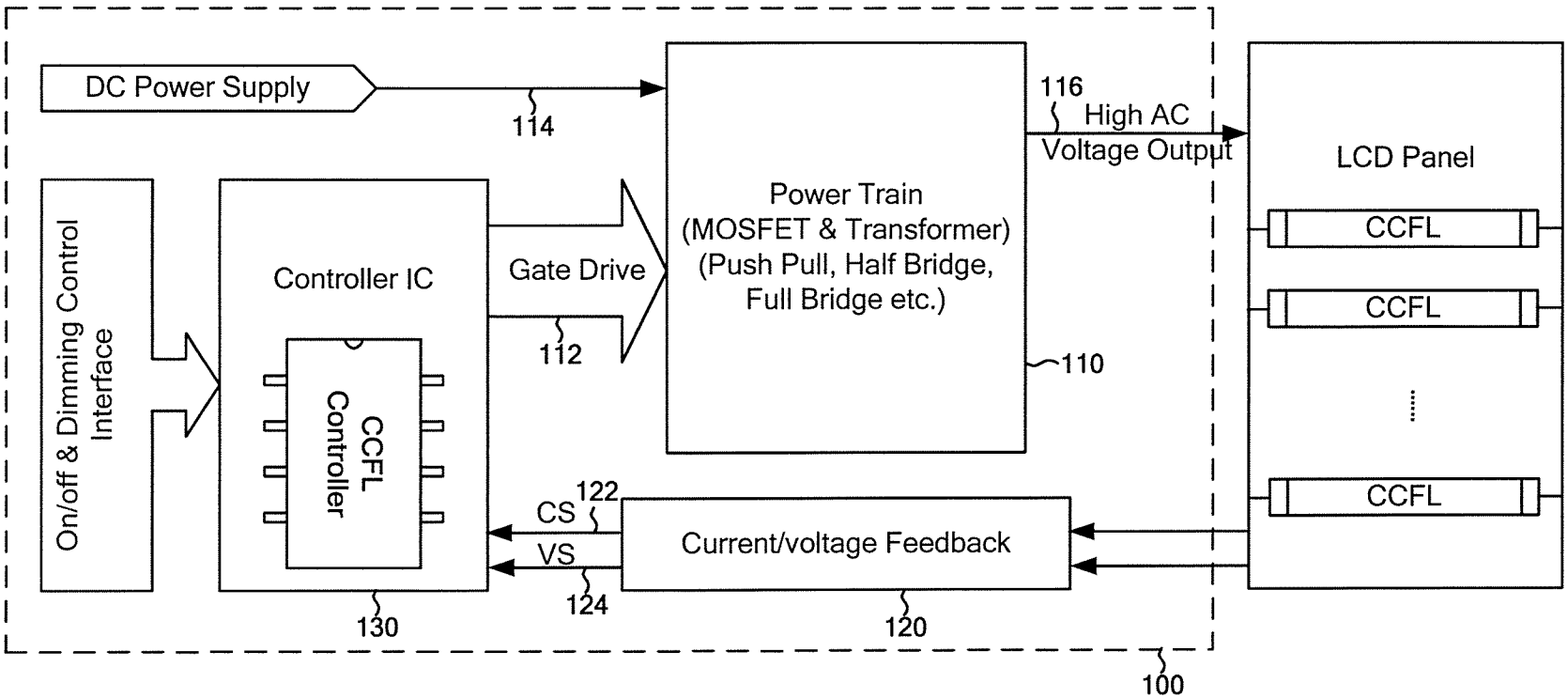
Figure 1 (Prior Art)
FIG. 1 is a simplified diagram showing a conventional control system for one or more CCFLs.
Figure 2A:
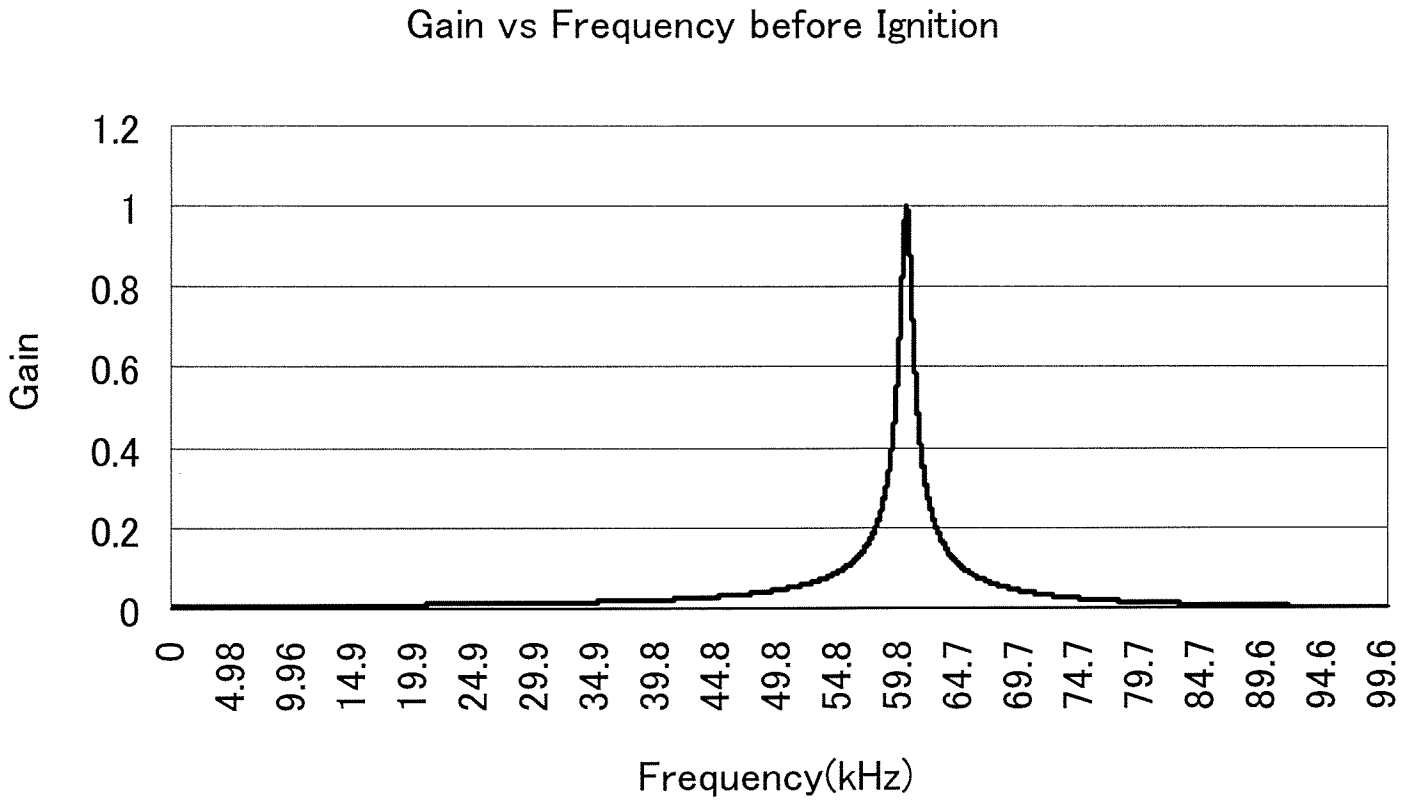
Figure 2(A) (Prior Art)
FIG. 2(A) is a simplified diagram showing a conventional voltage gain of the resonant LC network used by the power train component shown in FIG. 1 before successful ignition of a CCFL.
Figure 2B:
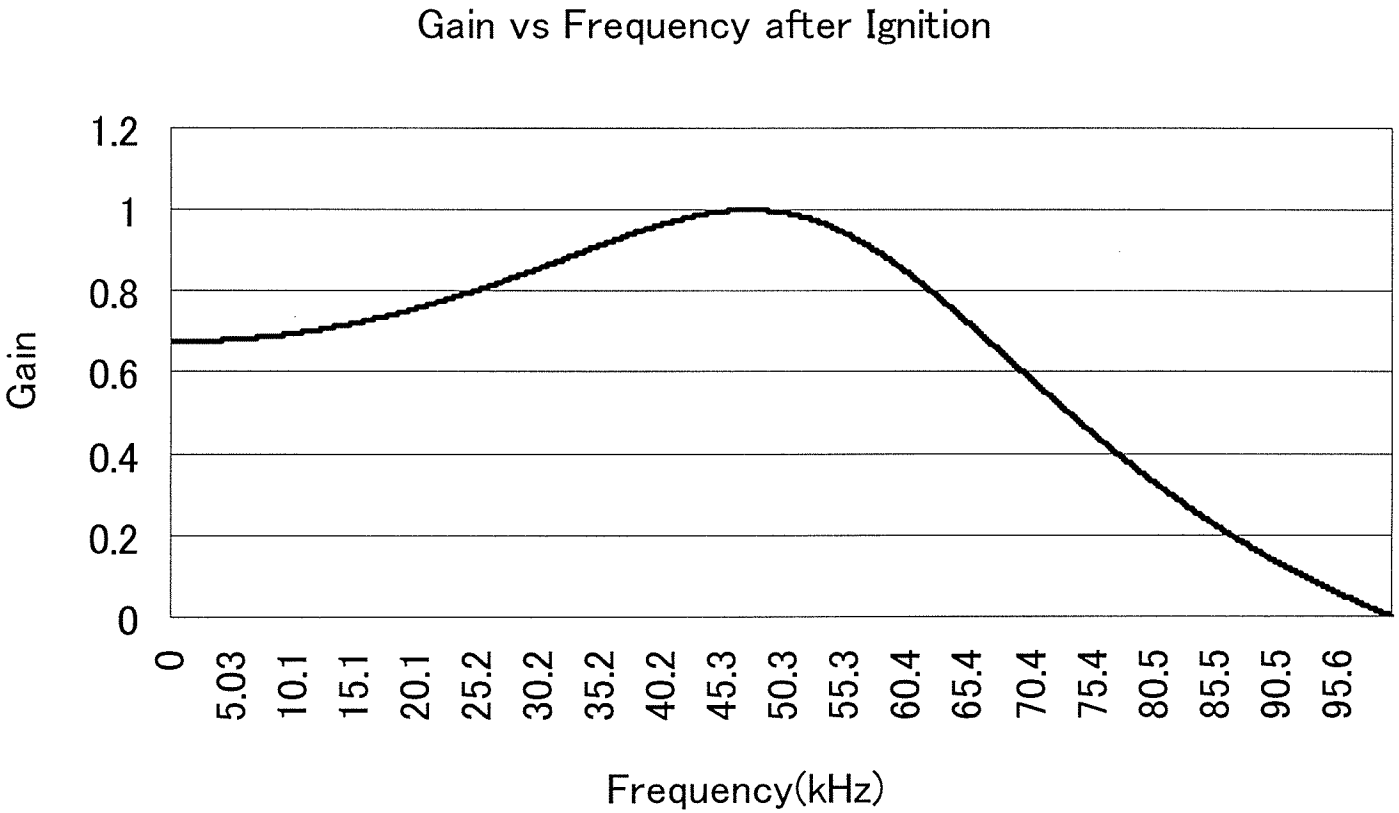
Figure 2(B) (Prior Art)
FIG. 2(B) is a simplified diagram showing a conventional voltage gain of the resonant LC network used by the power train component shown in FIG. 1 after successful ignition of the CCFL.

There are certain disadvantages for the control system 100. For different types of LCD display panels, the parasitic characteristics of the one or more CCFLs can vary significantly. For example, referring to FIGS. 2(A) and 2(B), if the parasitic capacitance is large, the voltage gain at the same frequency may drop dramatically after the successful ignition. Even after the ignition, the current-sensing signal 122 (e.g., $V_{cs}$) may remain smaller than the first threshold (e.g., $V_{th1}$). The successful ignition of the one or more CCFLs 132 may not be detected, and the control system 100 may fail to switch from the ignition operation to the normal operation. Eventually, the control system 100 may shut down the output of the AC voltage 116 if the successful ignition of the one or more CCFLs cannot be detected.

Additionally, after the successful ignition, there may be some transient changes in the CCFL current that can trigger the open loop protection and cause the control system 100 to shut down the output of the AC voltage 116, even though the CCFL current would have operated normally after the transient changes.

Figure 3:
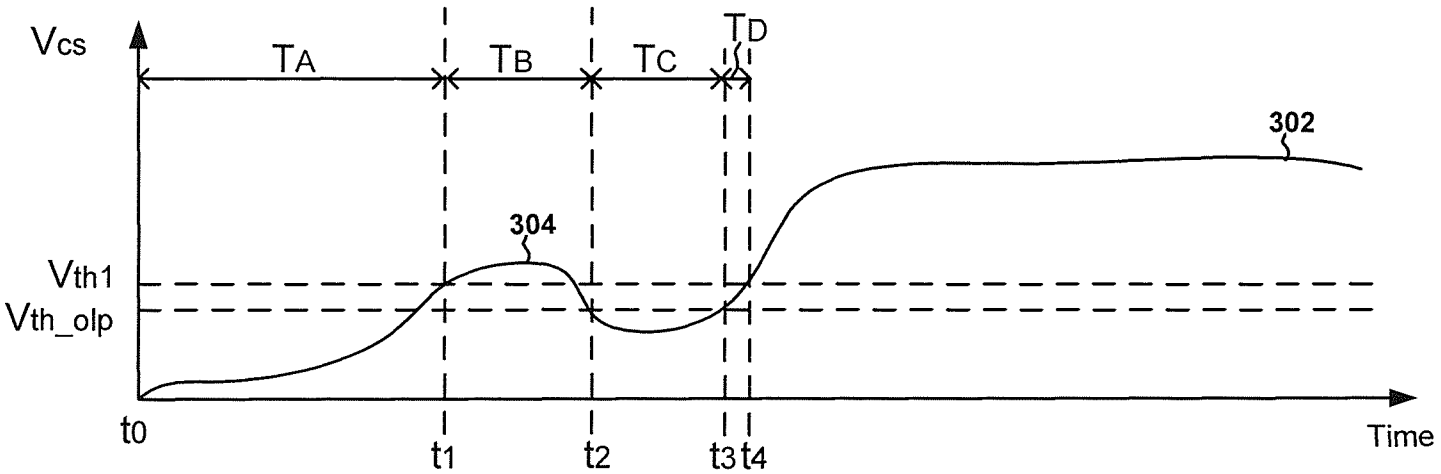
FIG. 3 is a simplified diagram showing an example of the current-sensing signal as a function of time for the conventional control system shown in FIG. 1.

FIG. 3 is a simplified diagram showing an example of the current-sensing signal 122 as a function of time for the conventional control system 100. A waveform 302 represents the current-sensing signal 122 as a function of time. Four time periods, $T_A$, $T_B$, $T_C$ and $T_D$ are shown in FIG. 3. The time period $T_A$ starts at time $t_0$, and ends at time $t_1$, and the time period $T_B$ starts at the time $t_1$, and ends at time $t_2$. Additionally, the time period $T_C$ starts at the time $t_2$, and ends at time $t_3$, and the time period $T_D$ starts at the time $t_3$, and ends at time $t_4$. For example, $t_0 \leq t_1 \leq t_2 \leq t_3 \leq t_4$.

In one embodiment, during the time period $T_A$, the current-sensing signal 122 is no larger than the first threshold (e.g., $V_{th1}$) in magnitude (e.g., as shown by the waveform 302). For example, the successful ignition of the one or more CCFLs 132 is not detected. In another example, the control system 100 does not switch from the ignition operation to the normal operation.

In another embodiment, at the beginning of the time period $T_B$ (e.g., at $t_1$), the current-sensing signal 122 (e.g., $V_{cs}$) becomes larger than the first threshold (e.g., $V_{th1}$) in magnitude (e.g., as shown by the waveform 302). For example, if the time $t_1$ is within the first predetermined period of time (e.g., $T_1$) during which the control system 100 keeps checking the current that flows through the one or more CCFLs 132, the control system 100 switches from the ignition operation to the normal operation. In another example, during the time period $T_B$, the current-sensing signal 122 increases to a peak value 304 in magnitude, and then decreases in magnitude (e.g., as shown by the waveform 302).

In yet another embodiment, at the beginning of the time period $T_C$ (e.g., at $t_2$), the current-sensing signal 122 (e.g., $V_{cs}$) drops below the open-loop threshold (e.g., $V_{th_olp}$) in magnitude (e.g., as shown by the waveform 302). For example, during the time period $T_C$, the current-sensing signal 122 (e.g., $V_{cs}$) keeps no larger than the open-loop threshold (e.g., $V_{th_olp}$) in magnitude. In another example, if the time period $T_C$ is equal to or longer than the predetermined open-loop period of time (e.g., $L_{olp}$) in length, the control system 100 triggers the open loop protection and shuts down the output of the AC voltage 116.

In yet another embodiment, at the beginning of the time period $T_D$, the current-sensing signal 122 (e.g., $V_{cs}$) becomes larger than the open-loop threshold (e.g., $V_{th_olp}$) in magnitude (e.g., as shown by the waveform 302). For example, during the time period $T_D$, the current-sensing signal 122 (e.g., $V_{cs}$) increases in magnitude. In another example, at the end of the time period $T_D$ (e.g., at $t_4$), the current-sensing signal 122 (e.g., $V_{cs}$) becomes larger than the first threshold (e.g., $V_{th1}$) in magnitude.

For example, the open loop protection may not be needed even if the time period $T_C$ is equal to or longer than the predetermined open-loop period of time (e.g., $T_{olp}$) in length, because the current-sensing signal 122 (e.g., $V_{cs}$) would have risen above the first threshold (e.g., $V_{th1}$) at $t_4$.

Figure 4A:
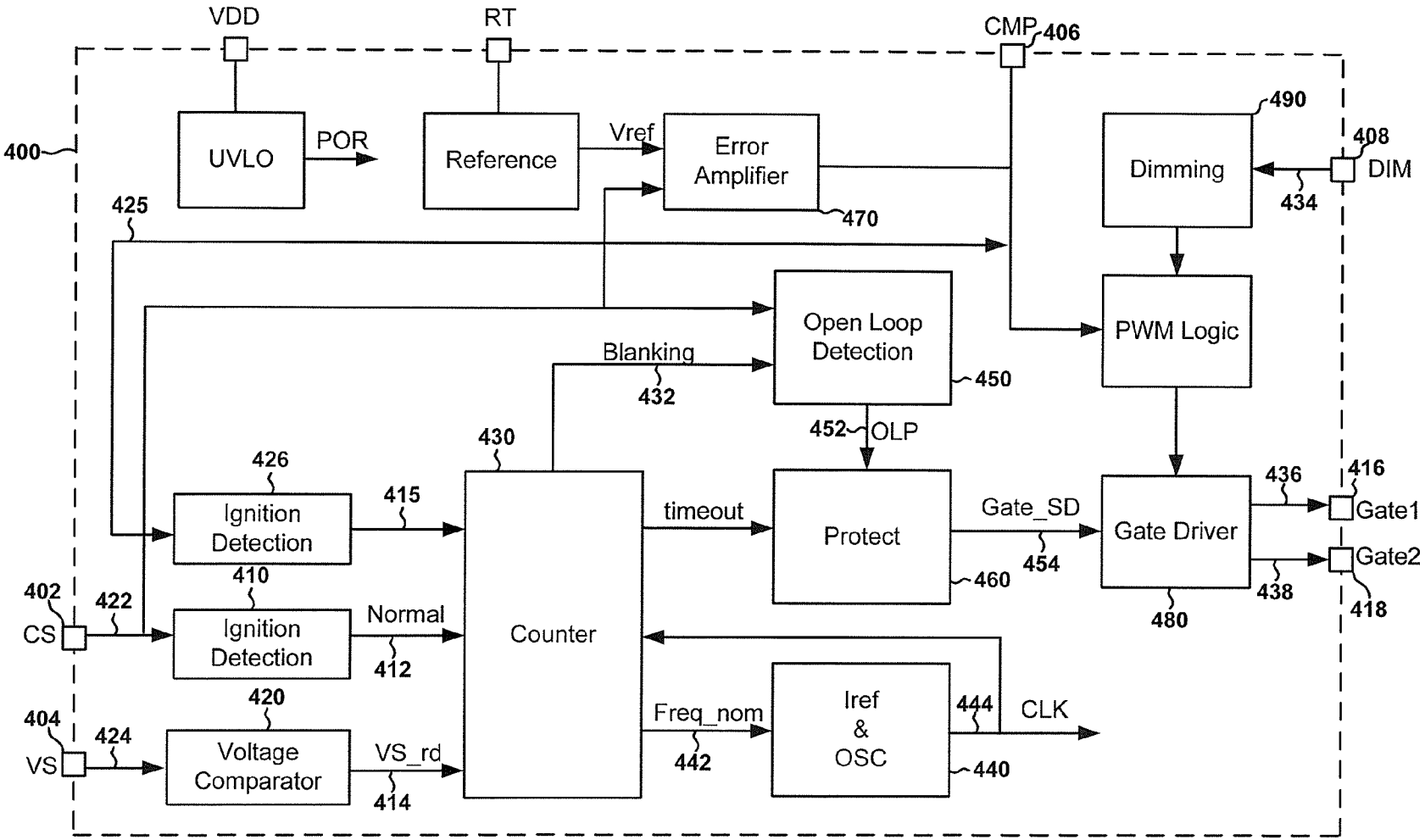
FIG. 4(A) is a simplified diagram showing a controller chip for one or more CCFLs according to an embodiment of the present invention.

FIG. 4(A) is a simplified diagram showing a controller chip for one or more CCFLs according to an embodiment of the present invention. This diagram is merely an example, which should not unduly limit the scope of the claims. One of ordinary skill in the art would recognize many variations, alternatives, and modifications.

The controller chip 400 includes an ignition detection component 410, two voltage comparators 420 and 426, a counter 430, a reference current and clock signal generator 440, an open-loop detection component 450, an protection component 460, an error amplifier 470, a gate driver 480, and a dimming-control component 490. Additionally, the controller chip 400 includes six terminals 402, 404, 406, 408, 416 and 418.

For example, the reference current and clock signal generator 440 includes a reference current generation module and the clock signal generation module, where the current generation module provides a reference current to the clock signal generation module and the clock signal generation module in response outputs a clock signal that is used to determine the switching frequency of a gate drive signal.

Figure 4B:
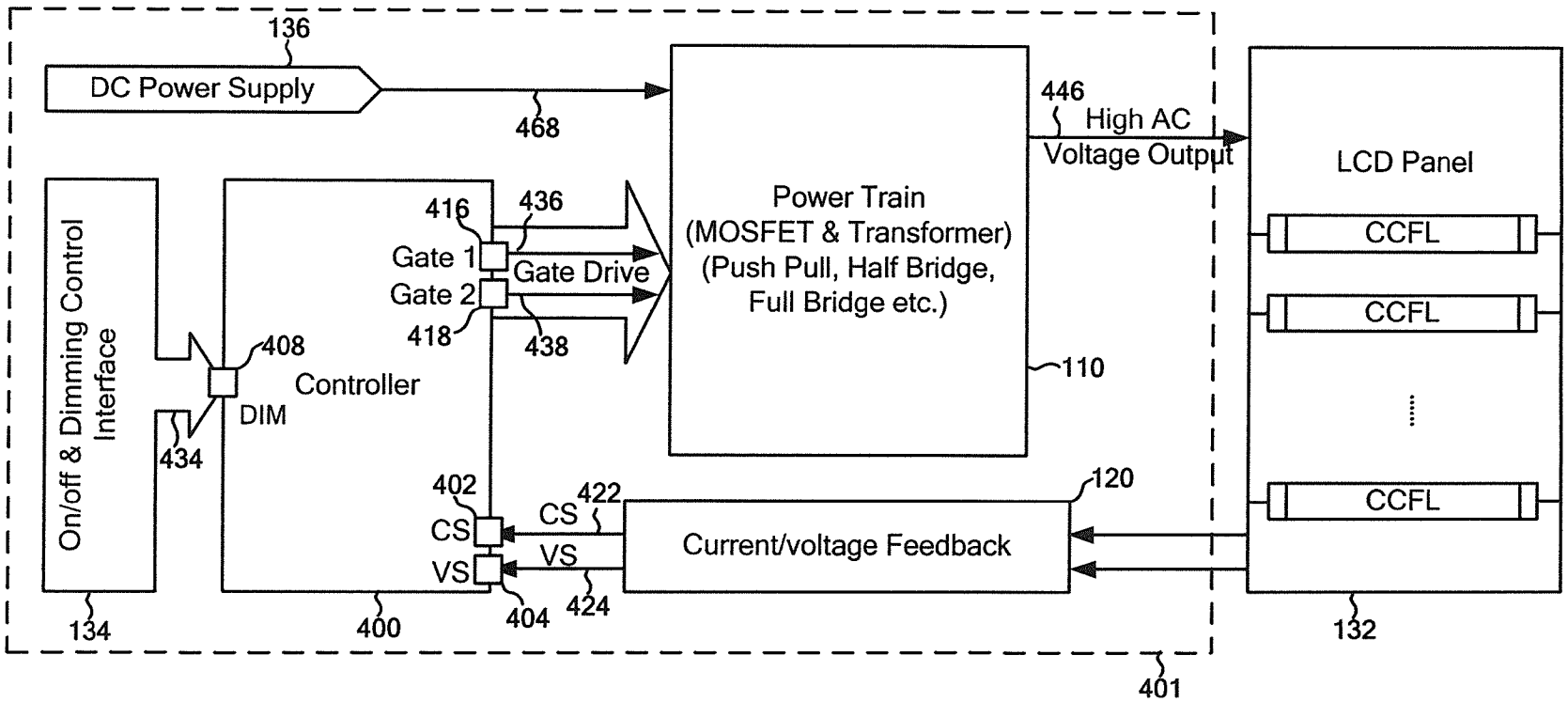
FIG. 4(B) is a simplified diagram showing a control system for one or more CCFLs according to an embodiment of the present invention.

FIG. 4(B) is a simplified diagram showing a control system for one or more CCFLs according to an embodiment of the present invention. This diagram is merely an example, which should not unduly limit the scope of the claims. One of ordinary skill in the art would recognize many variations, alternatives, and modifications.

As shown in FIG. 4(B), the controller chip 400 is used with the power train component 110 and the current/voltage feedback component 120 as parts of a control system 401 for one or more CCFLs 132. The control system 401 also includes the dimming-control interface 134 and the DC power supply 136. In some embodiments, the terminal 418 (e.g., terminal Gate 2) is removed.

Referring to FIG. 4(A) and FIG. 4(B), the controller chip 400 receives a dimming-control signal 434 at the terminal 408 (e.g., terminal DIM) from the dimming-control interface 134, and in response generates a gate drive signal 436 at the terminal 416 (e.g., terminal Gate 1) and/or a gate drive signal 438 at the terminal 418 (e.g., terminal Gate 2) according to certain embodiments. For example, the power train component 110 receives the gate drive signal 436 and/or the gate drive signal 438 from the controller chip 400, and in response converts a DC voltage 468 generated by the DC power supply 136 to an AC voltage 446. In another example, the power train component 110 uses a voltage boost transformer and a resonant LC network to generate the AC voltage 446. In yet another example, the AC voltage 446 that is applied to the one or more CCFLs 132 is converted to a voltage-sensing signal 424 (e.g., $V_{cs}$) by the current/voltage feedback component 120. In yet another example, the controller chip 400 receives the voltage-sensing signal 424 (e.g., $V_{vs}$) at the terminal 404 (e.g., terminal VS). In yet another example, a current that flows through the one or more CCFLs 132 is also converted to a current-sensing signal 422 (e.g., $V_{cs}$) by the current/voltage feedback component 120. In yet another example, the current-sensing signal 422 (e.g., $V_{cs}$) is also received by the controller chip 400 at the terminal 402 (e.g., terminal CS). In yet another example, the controller chip 400 generates the gate drive signal 436 and/or the gate drive signal 438 and regulates the AC voltage 116 to a predetermined magnitude and a predetermined frequency. In yet another example, when the gate drive signal 436 is at a logic high level, the gate drive signal 438 is at a logic low level. In yet another example, when the gate drive signal 436 is at the logic low level, the gate drive signal 438 is at the logic high level.

Figure 5:
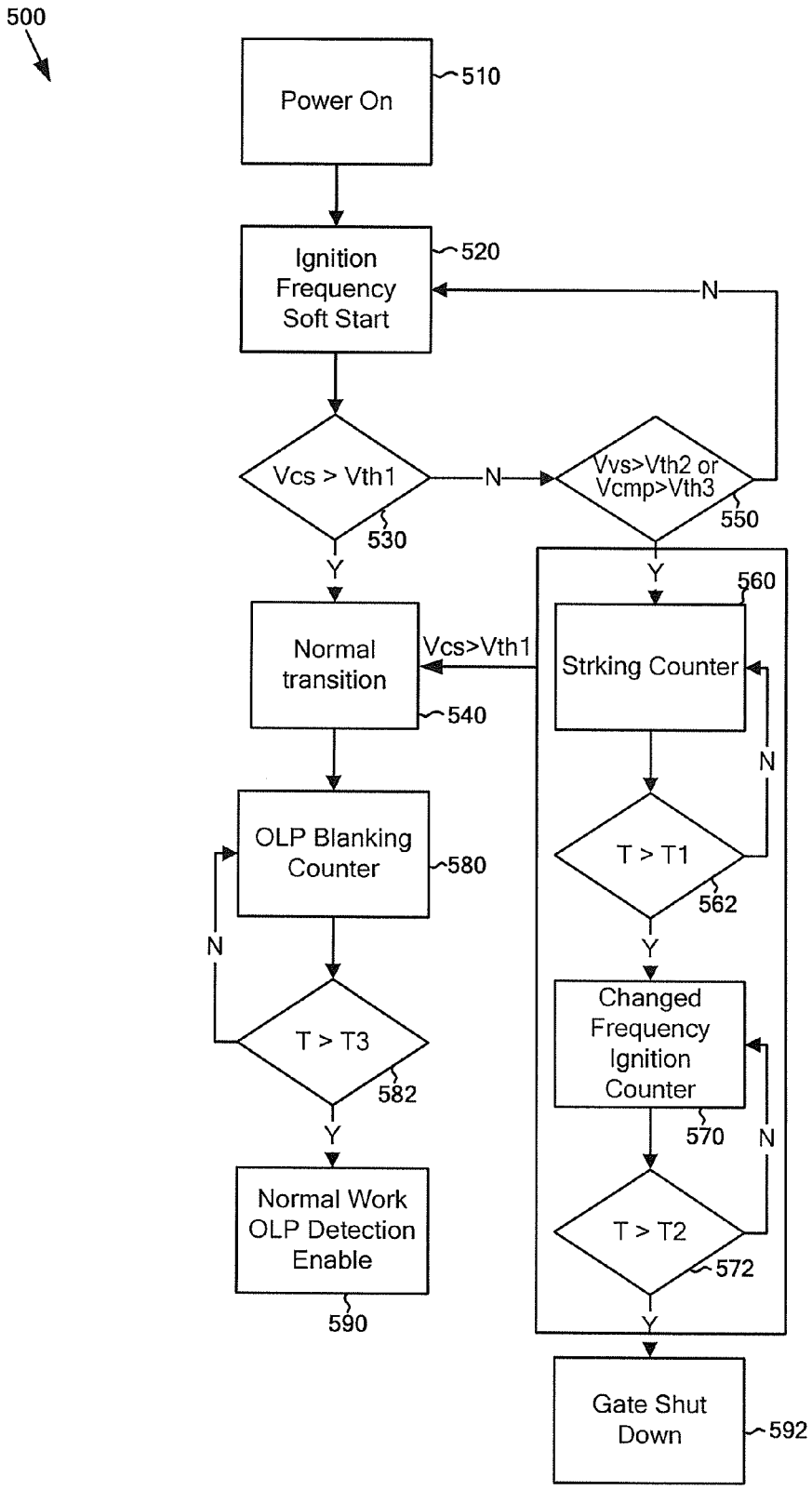
FIG. 5 is a simplified diagram showing a method for controlling one or more CCFLs according to an embodiment of the present invention.

FIG. 5 is a simplified diagram showing a method for controlling one or more CCFLs according to an embodiment of the present invention. This diagram is merely an example, which should not unduly limit the scope of the claims. One of ordinary skill in the art would recognize many variations, alternatives, and modifications. For example, the method 500 includes processes 510, 520, 530, 540, 550, 560, 562, 570, 572, 580, 582, 590, and 592. In another example, the method 500 is implemented by the controller chip 400. In yet another example, the method 500 is implemented by the control system 401 that includes the controller chip 400.

At the process 510, the control system 401 is powered on according to one embodiment. At the process 520, the control system 401 generates the AC voltage 446 with a first predetermined frequency (e.g., $f_1$) and a predetermined magnitude, and outputs the generated AC voltage 446 to ignite the one or more CCFLs 132 according to another embodiment. For example, the process 520 is performed by at least receiving the voltage-sensing signal 424 (e.g., $V_{vs}$) by the voltage comparator 420. In another example, the controller chip 400 in response generates the gate drive signal 436 and/or the gate drive signal 438 and regulates the AC voltage 446. In yet another example, after the AC voltage 446 reaches the first predetermined frequency (e.g., $f_1$) and the predetermined magnitude, the voltage comparator 420 outputs a timer signal 414. In yet another example, the counter 430 starts the first predetermined period of time (e.g., $T_1$).

At the process 530, it is determined whether the one or more CCFLs 132 have been ignited according to yet another embodiment. If the one or more CCFLs 132 are determined to have been ignited, the process 540 is performed, and if the one or more CCFLs 132 are not determined to have been ignited, the process 550 is performed. For example, the current-sensing signal 422 (e.g., $V_{cs}$) is received by the ignition detection component 410 and compared with a first threshold (e.g., $V_{th1}$). In another example, if the current-sensing signal 422 (e.g., $V_{cs}$) becomes larger than the first threshold (e.g., $V_{th1}$), the ignition detection system 410 determines the one or more CCFLs 132 have been ignited and outputs a signal 412 to the counter 430.

At the process 540, the control system 401, in response to the signal 412, switches from the ignition operation to the normal operation according to yet another embodiment. For example, the AC voltage 446 is changed from the first predetermined frequency (e.g., $f_1$) to a predetermined normal frequency $f_{norm}$.

At the process 550, it is determined whether the voltage-sensing signal 424 is larger than a second threshold (e.g., $V_{th2}$) and/or whether an output signal 425 (e.g., $V_{cmp}$) generated by the error amplifier 470 is larger than a third threshold (e.g., $V_{th3}$) according to some embodiments. If the voltage-sensing signal 424 is not determined to be larger than the second threshold (e.g., $V_{th2}$) and the output signal 425 (e.g., $V_{cmp}$) is not determined to be larger than the third threshold (e.g., $V_{th3}$), the process 520 is performed. If the voltage-sensing signal 424 is determined to be larger than the second threshold (e.g., $V_{th2}$) and/or the output signal 425 (e.g., $V_{cmp}$) is determined to be larger than the third threshold (e.g., $V_{th3}$), the process 560 is performed.

For example, the voltage comparator 420 receives the voltage-sensing signal 424 (e.g., $V_{vs}$) and compares the voltage-sensing signal 424 (e.g., $V_{vs}$) with the second threshold (e.g., $V_{th2}$). In another example, if the voltage-sensing signal 424 (e.g., $V_{vs}$) is determined to be larger than the second threshold (e.g., $V_{th2}$), the voltage comparator 420 outputs the timer signal 414. In yet another example, the voltage comparator 426 receives the output signal 425 (e.g., $V_{cmp}$) from the error amplifier 470, and compares the output signal 425 with the third threshold (e.g., $V_{th3}$). In yet another example, if the output signal 425 is determined to be larger than the third threshold (e.g., $V_{th3}$), the voltage comparator 426 outputs a signal 415.

Returning to FIG. 5, at the processes 560 and 562, the AC voltage 446 with the first predetermined frequency (e.g., $f_1$) keeps being applied to the one or more CCFLs 132 for the first predetermined period of time (e.g., $T_1$) according to certain embodiments. For example, during the first predetermined period of time (e.g., $T_1$), as part of the processes 560 and 562, it is also determined whether the one or more CCFLs 132 have been ignited. In another example, if the one or more CCFLs 132 are determined to have been ignited, the processes 560 and 562 are terminated and the process 540 is performed. In yet another example, if the one or more CCFLs 132 are still not determined to have been ignited after the first predetermined period of time (e.g., $T_1$), the processes 570 and 572 are performed. As shown in FIG. 4(A), the counter 430 receives the timer signal 414 and the signal 415, and determines whether the first predetermined period of time (e.g., $T_1$) has expired.

At the processes 570 and 572, the AC voltage 446 applied to the one or more CCFLs 132 is changed from the first predetermined frequency (e.g., $f_1$) to a second predetermined frequency (e.g., $f_2$), and the AC voltage 446 with the second predetermined frequency (e.g., $f_2$) is applied to the one or more CCFLs 132 for the second predetermined period of time (e.g., $T_2$) according to one embodiment. For example, the reference current and clock signal generator 440 receives a signal 442 and, in response, generates a clock signal 444 with the second predetermined frequency (e.g., $f_2$). In another example, the second predetermined frequency (e.g., $f_2$) is equal to the predetermined normal frequency $f_{norm}$. In yet another example, the second predetermined frequency (e.g., $f_2$) is different from the predetermined normal frequency $f_{norm}$. In yet another example, the first predetermined frequency (e.g., $f_1$) is equal to or close to a resonant frequency of the resonant LC network used by the power train component 110 in the control system 401 before successful ignition of the one or more CCFLs 132. In yet another example, the second predetermined frequency (e.g., $f_2$) is equal to or close to a resonant frequency of the resonant LC network used by the power train component 110 in the control system 401 after successful ignition of the one or more CCFLs 132.

According to another embodiment, during the second predetermined period of time (e.g., $T_2$), as part of the processes 570 and 572, it is also determined whether the one or more CCFLs 132 have been ignited. For example, if the one or more CCFLs 132 are determined to have been ignited, the processes 570 and 572 are terminated and the process 540 is performed. In another example, if the one or more CCFLs 132 are still not determined to have been ignited after the second predetermined period of time (e.g., $T_2$), the process 592 is performed. As shown in FIG. 4(A), the counter 430 determines whether the second predetermined period of time (e.g., $T_2$) has expired according to certain embodiments.

Returning to FIG. 5, at the process 592, the output of the AC voltage 446 to the one or more CCFLs 132 is shut down according to another embodiment. Also as shown in FIG. 5, after the process 540, the processes 580 and 582 are performed. At the processes 580 and 582, after the control system 401 switches from the ignition operation to the normal operation, the open-loop protection of the control system 401 is blanked or disabled for a third predetermined period of time (e.g., $T_3$) according to yet another embodiment. For example, the counter 430 outputs a signal 432 to the open-loop detection component 450, and blanks or disables the open-loop detection component 450 for the third predetermined period of time (e.g., $T_3$).

After the processes 580 and 582 are completed, the process 590 is performed. At the process 590, it is determined whether the open-loop protection should be triggered, and if the open-loop protection should be triggered, the control system 401 enters into the protection mode according to one embodiment. According to another embodiment, the open-loop detection component 450 compares the current-sensing signal 422 (e.g., $V_{cs}$) with an open-loop threshold (e.g., $V_{th_olp}$).

For example, if the current-sensing signal 422 (e.g., $V_{cs}$) is determined to be smaller than the open-loop threshold (e.g., $V_{th_olp}$) in magnitude for a predetermined open-loop period of time (e.g., $T_{olp}$), the open-loop detection component 450 outputs an OLP signal 452 to the protection component 460, which in response generates a signal 454 to affect to the gate drive signal 436 and/or the gate drive signal 438 to shut down the output of the AC voltage 446 to the one or more CCFLs 132.

According to certain embodiments, the counter 430 is used in one or more processes as shown in FIG. 5. For example, the counter 430 is used to determine one or more time periods, e.g., as shown in the process 560, the process 562, the process 572 and/or the process 582. In another example, the counter 430 includes one or more control components that are used for changing or maintaining the frequency and/or the magnitude of the AC voltage 446, e.g., as shown in the process 520, the process 540, and/or the process 570. In yet another example, the counter 430 is used as part of certain system protection schemes (e.g., open loop protection), e.g., as shown in the process 580, the process 582 and/or the process 590.

Referring to FIGS. 4(A), 4(B) and 5, a current that flows through the one or more CCFLs 132 after successful ignition is, for example, determined as follows:

$$I_{CCFL} = V_{in} \times N \times \frac{2}{\pi} \times \sin\left(\frac{\pi}{2}D\right) \times \left|\frac{1}{R - 4\pi^2 RCLf^2 + j2\pi fL}\right| \quad \text{(Equation 2)}$$

where $I_{CCFL}$ represents the current that flows through the one or more CCFLs 132 after successful ignition. Additionally, $V_{in}$ represents the magnitude of the DC voltage 468, and f represents the frequency of the AC voltage 446. Moreover, C represents the parasitic capacitance of the one or more CCFLs 132. Also, N, D, R, and L are constant parameters that are determined by the control system 401.

Figure 6:
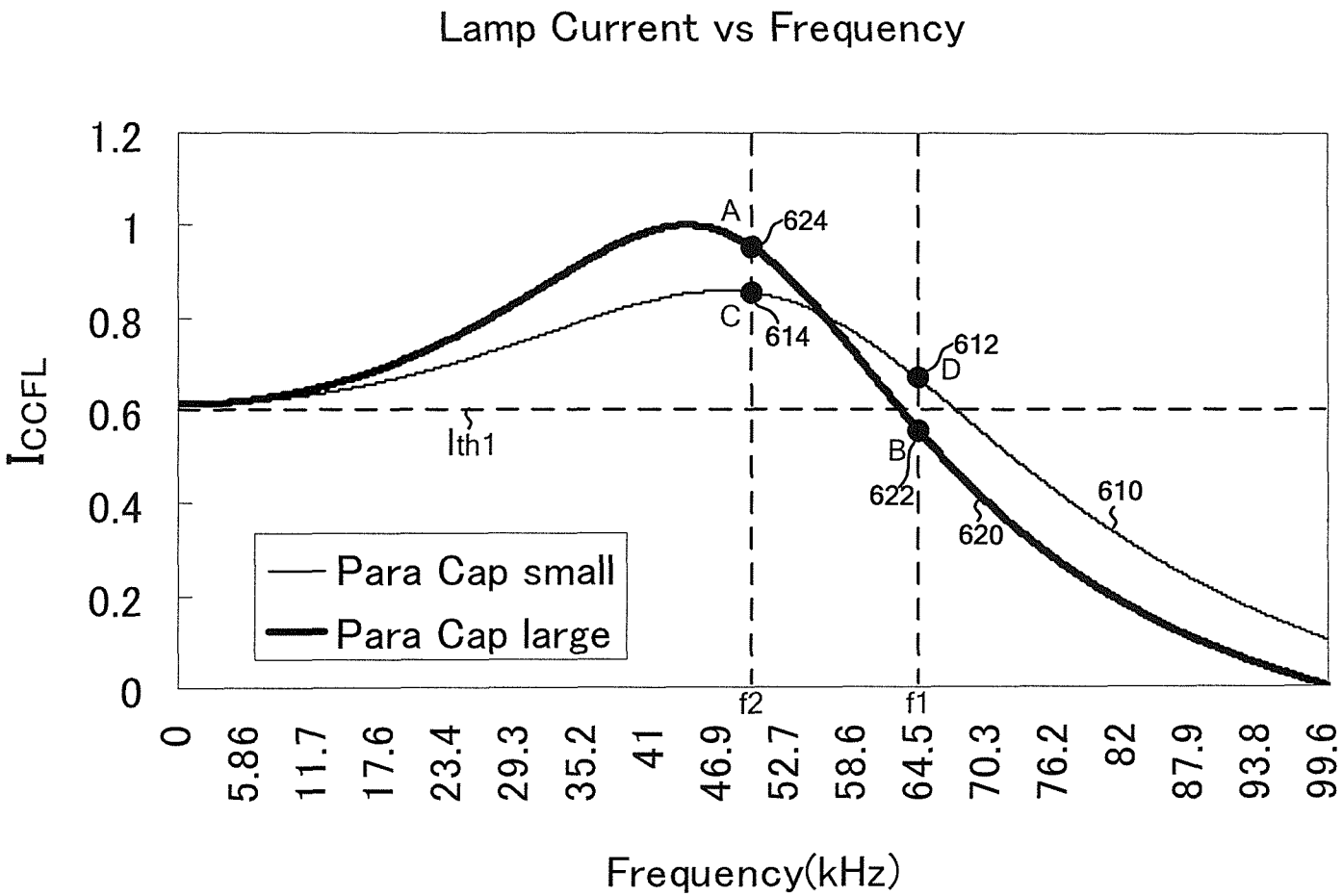
FIG. 6 is a simplified diagram showing examples of the current that flows through the one or more CCFLs as a function of voltage frequency after successful ignition of the one or more CCFLs as shown in FIGS. 4(A), 4(B) and 5.

FIG. 6 is a simplified diagram showing examples of the current that flows through the one or more CCFLs 132 as a function of voltage frequency after successful ignition of the one or more CCFLs 132 as shown in FIGS. 4(A), 4(B) and 5. A waveform 610 represents the current that flows through the one or more CCFLs 132 as a function of voltage frequency after successful ignition for smaller parasitic capacitance, and a waveform 620 represents the current that flows through the one or more CCFLs 132 as a function of voltage frequency after successful ignition for larger parasitic capacitance. Additionally, the threshold current $I_{th1}$ corresponds to the first threshold $V_{th1}$.

According to one embodiment, if the parasitic capacitance is small, the current that flows through the one or more CCFLs 132 has a magnitude 612 at the first predetermined frequency $f_1$, and has a magnitude 614 at the second predetermined frequency $f_2$ (e.g., as shown by the waveform 610). For example, after the successful ignition, the current that flows through the one or more CCFLs 132 is larger than the threshold current $I_{th1}$ in magnitude at both the first predetermined frequency $f_1$ and the second predetermined frequency $f_2$. Hence, the successful ignition of the one or more CCFLs 132 can be detected at both the first predetermined frequency $f_1$ and the second predetermined frequency $f_2$ according to certain embodiments.

According to another embodiment, if the parasitic capacitance is large, the current that flows through the one or more CCFLs 132 has a magnitude 622 at the first predetermined frequency $f_1$, and has a magnitude 624 at the second predetermined frequency $f_2$ (e.g., as shown by the waveform 620). For example, the current that flows through the one or more CCFLs 132, even after the successful ignition, is smaller than the threshold current $I_{th1}$ in magnitude at the first predetermined frequency $f_1$. Hence the successful ignition of the one or more CCFLs 132 cannot be detected at the first predetermined frequency $f_1$ according to certain embodiments.

But, for example, if the frequency of the AC voltage 446 is changed from the first predetermined frequency $f_2$ after the successful ignition to the second predetermined frequency $f_2$ during the ignition operation, the current that flows through the one or more CCFLs 132 becomes larger than the threshold current $I_{th1}$ at the second predetermined frequency $f_2$. Hence, the successful ignition of the one or more CCFLs 132 can be detected at the second predetermined frequency $f_2$ according to some embodiments.

Figure 7:
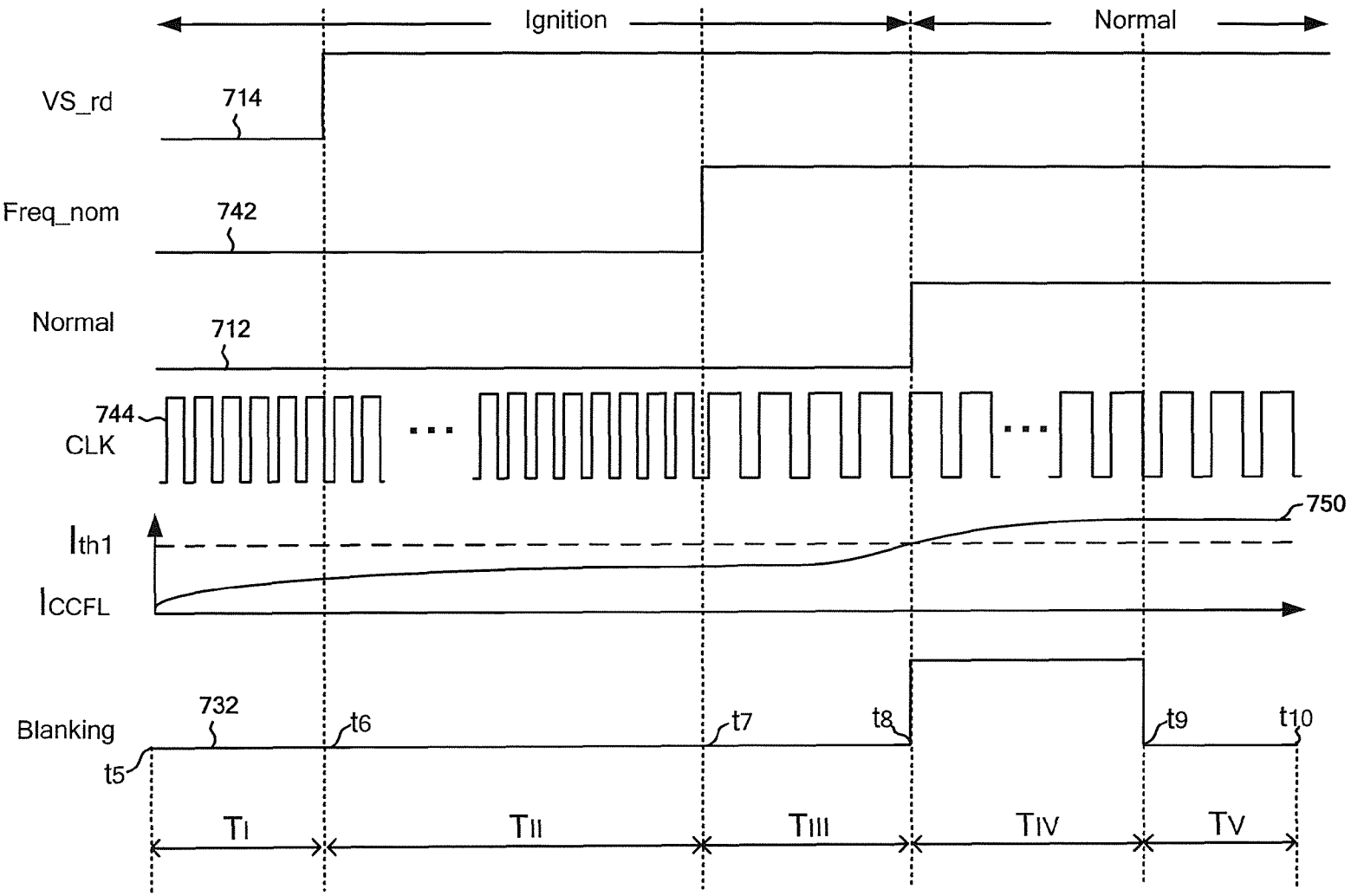
FIG. 7 shows simplified timing diagrams for the control system shown in FIG. 4(B) according to an embodiment of the present invention.

FIG. 7 shows simplified timing diagrams for the control system 401 according to an embodiment of the present invention. These timing diagrams are merely examples, which should not unduly limit the scope of the claims. One of ordinary skill in the art would recognize many variations, alternatives, and modifications.

Waveforms 714, 742, 712, 732 and 744 represent the signals 414, 442, 412, 432 and 444 as functions of time respectively, and a waveform 750 represents the current that flows through the one or more CCFLs 132 as a function of time. Five time periods, $T_I$, $T_{II}$, $T_{III}$, $T_{IV}$, and $T_V$ are shown in FIG. 7. The time period $T_I$ starts at time $t_5$, and ends at time $t_6$, and the time period $T_{II}$ starts at the time $t_6$, and ends at time $t_7$. Additionally, the time period $T_{III}$ starts at the time $t_7$, and ends at time $t_8$, the time period $T_{IV}$ starts at the time $t_8$, and ends at time $t_9$, and the time period $T_V$ starts at the time $t_9$, and ends at time $t_{10}$ For example, $t_5 \le t_6 \le t_7 \le t_8 \le t_9 \le t_{10}$.

In the time period $T_1$, the process 520 is performed according to one embodiment. For example, during the time period $T_I$, the current that flows through the one or more CCFLs 132 keeps lower than the threshold current (e.g., $I_{thI}$) in magnitude (e.g., as shown by the waveform 750). In another example, at the end of the time period $T_I$ (e.g., at $t_6$), the signal 414 changes from a logic low level to a logic high level (e.g., as shown by the waveform 714), if the AC voltage 446 reaches the first predetermined frequency (e.g., $f_1$) and the predetermined magnitude. In yet another example, the first predetermined period of time (e.g., $T_I$) starts.

In the time period $T_{II}$, the processes 530, 550, 560 and 562 are performed according to another embodiment. For example, during the time period $T_{II}$, the current that flows through the one or more CCFLs 132 remains lower than the threshold current (e.g., $I_{th1}$) in magnitude (e.g., as shown by the waveform 750). In another example, during the time period $T_{II}$, the one or more CCFLs 132 are still not determined to have been ignited. In yet another example, if the time period $T_{II}$ is equal to or longer than the first predetermined period of time (e.g., $T_I$), the signal 442 changes from the logic low level to the logic high level at the end of the time period $T_{II}$ (e.g., at $t_7$) as shown by the waveform 742. In yet another example, the logic low level of the signal 442 corresponds to the first predetermined frequency (e.g., $f_1$), and the logic high level of the signal 442 corresponds to the second predetermined frequency (e.g., $f_2$). In yet another example, the second predetermined frequency (e.g., $f_2$) is equal to the predetermined normal frequency $f_{norm}$. In yet another example, the second predetermined frequency (e.g., $f_2$) is lower than the first predetermined frequency (e.g., $f_1$). In yet another example, the clock signal 444 changes from the first predetermined frequency to the second predetermined frequency (e.g., as shown by the waveform 744).

In the time period $T_{III}$, the processes 570, 572 and 540 are performed according to yet another embodiment. For example, during the time period $T_{III}$, the current that flows through the one or more CCFLs 132 keeps no larger than the threshold current (e.g., $I_{th1}$) in magnitude (e.g., as shown by the waveform 750). In another example, at the end of the time period $T_{III}$ (e.g., at $t_8$), the current that flows through the one or more CCFLs 132 becomes equal to or larger than the threshold current (e.g., $I_{th1}$) in magnitude (e.g., as shown by the waveform 750). The one or more CCFLs 132 are determined to have been ignited, and thus the control system 401 switches from the ignition operation to the normal operation according to certain embodiments. For example, at the end of the time period $T_{III}$ (e.g., at $t_8$), the signal 412 changes from the logic low level to the logic high level (e.g., as shown by the waveform 712). In another example, the logic low level of the signal 412 corresponds to the ignition operation, and the logic high level of the signal 412 corresponds to the normal operation. In yet another example, at the end of the time period $T_{III}$ (e.g., at $t_8$), the signal 432 changes from the logic low level to the logic high level (e.g., as shown by the waveform 732). In another example, the logic high level of the signal 432 corresponds to blanking or disablement of the open-loop protection of the control system 401.

In the time period $T_{IV}$, the processes 580 and 582 are performed according to yet another embodiment. For example, the signal 432 remains at the logic high level during the time period $T_{IV}$ (e.g., as shown by the waveform 732). In another example, the open-loop protection is disabled or blanked. In yet another example, the time period $T_{IV}$ is equal to or longer than the third predetermined period of time (e.g., $T_3$).

In the time period $T_V$, the process 590 is performed according to yet another embodiment. For example, at the beginning of the time period $T_V$ (e.g., at $t_9$), if it is determined that the open-loop protection should be triggered, the signal 432 changes from the logic high level to the logic low level. In another example, the control system 401 enters into the protection mode.

As shown in FIG. 7, the control system 401 is in the ignition operation in the time periods $T_I$, $T_{II}$ and $T_{III}$, even though the one or more CCFLs 132 may have been successfully ignited in the time period $T_{II}$ according to certain embodiments. According to some embodiments, in the time periods $T_{IV}$ and $T_V$, the control system 401 is in the normal operation after the successful ignition has been detected in the time period $T_{III}$.

According to another embodiment, a method for driving one or more cold-cathode fluorescent lamps includes generating at least one drive signal associated with a signal frequency, the signal frequency being equal to a first predetermined frequency, receiving a current-sensing signal, the current-sensing signal being associated with a lamp current for the one or more cold-cathode fluorescent lamps in response to at least the first predetermined frequency, and determining whether the current-sensing signal is larger than a first threshold in magnitude, the current-sensing signal being related to the first predetermined frequency. Additionally, the method includes, if the current-sensing signal related to the first predetermined frequency is determined to be larger than the first threshold in magnitude at anytime during a first period of time, changing the signal frequency from the first predetermined frequency to a second predetermined frequency, the second predetermined frequency being different from the first predetermined frequency. Further, the method includes, if the current-sensing signal related to the first predetermined frequency is determined to be smaller than the first threshold in magnitude throughout the first period of time, changing the signal frequency from the first predetermined frequency to a third predetermined frequency, the third predetermined frequency being different from the first predetermined frequency, generating at least the drive signal associated with the signal frequency, the signal frequency being equal to the third predetermined frequency, receiving the current-sensing signal, the current-sensing signal being associated with the lamp current in response to at least the third predetermined frequency, and determining whether the current-sensing signal is larger than the first threshold in magnitude, the current-sensing signal being related to the third predetermined frequency. Moreover, the method includes, if the current-sensing signal related to the third predetermined frequency is determined to be larger than the first threshold in magnitude at anytime during a second period of time, changing the signal frequency from the third predetermined frequency to the second predetermined frequency if the second predetermined frequency is different from the third predetermined frequency. For example, the method is implemented according to at least FIG. 4(A), FIG. 4(B), FIG. 5, FIG. 6, and/or FIG. 7.

According to another embodiment, a method for driving one or more cold-cathode fluorescent lamps includes generating at least one drive signal associated with a signal frequency, the signal frequency being equal to a first predetermined frequency, receiving a current-sensing signal, the current-sensing signal being associated with a lamp current for the one or more cold-cathode fluorescent lamps in response to at least the first predetermined frequency, and determining whether the current-sensing signal is larger than a first threshold in magnitude, the current-sensing signal being related to the first predetermined frequency. Additionally, the method includes, if the current-sensing signal related to the first predetermined frequency is determined to be larger than the first threshold in magnitude, generating at least the drive signal related to a second predetermined frequency, the second predetermined frequency being the same as or different from the first predetermined frequency, for a first period of time, maintaining or changing at least the drive signal, not in response to whether the current-sensing signal related to the second predetermined frequency is smaller than a second threshold in magnitude, and after the first period of time, determining whether the current-sensing signal related to the second predetermined frequency is smaller than the second threshold in magnitude. The method further includes, if the current-sensing signal related to the second predetermined frequency is determined to be smaller than the second threshold in magnitude throughout a second period of time, changing the drive signal in order to turn off the one or more cold-cathode fluorescent lamps, wherein the second period of time begins no earlier than an end of the first period of time. For example, the method is implemented according to at least FIG. 4(A), FIG. 4(B), FIG. 5, and/or FIG. 7.

According to yet another embodiment, a system for driving one or more cold-cathode fluorescent lamps includes a system controller. The system controller is configured to generate at least one drive signal associated with a signal frequency, the signal frequency being equal to a first predetermined frequency, receive a current-sensing signal, the current-sensing signal being associated with a lamp current for the one or more cold-cathode fluorescent lamps in response to at least the first predetermined frequency, and determine whether the current-sensing signal is larger than a first threshold in magnitude, the current-sensing signal being related to the first predetermined frequency. In addition, the system controller is configured to, if the current-sensing signal related to the first predetermined frequency is determined to be larger than the first threshold in magnitude at anytime during a first period of time, change the signal frequency from the first predetermined frequency to a second predetermined frequency, the second predetermined frequency being different from the first predetermined frequency. Further, the system controller is configured to, if the current-sensing signal related to the first predetermined frequency is determined to be smaller than the first threshold in magnitude throughout the first period of time, change the signal frequency from the first predetermined frequency to a third predetermined frequency, the third predetermined frequency being different from the first predetermined frequency, generate at least the drive signal associated with the signal frequency, the signal frequency being equal to the third predetermined frequency, receive the current-sensing signal, the current-sensing signal being associated with the lamp current in response to at least the third predetermined frequency, and determine whether the current-sensing signal is larger than the first threshold in magnitude, the current-sensing signal being related to the third predetermined frequency. Moreover, the system controller is configured to, if the current-sensing signal related to the third predetermined frequency is determined to be larger than the first threshold in magnitude at anytime during a second period of time, change the signal frequency from the third predetermined frequency to the second predetermined frequency if the second predetermined frequency is different from the third predetermined frequency. For example, the system is implemented according to at least FIG. 4(A), FIG. 4(B), FIG. 5, FIG. 6, and/or FIG. 7.

According to yet another embodiment, a system for driving one or more cold-cathode fluorescent lamps includes a system controller. The system controller is configured to generate at least one drive signal associated with a signal frequency, the signal frequency being equal to a first predetermined frequency, receive a current-sensing signal, the current-sensing signal being associated with a lamp current for the one or more cold-cathode fluorescent lamps in response to at least the first predetermined frequency, and determine whether the current-sensing signal is larger than a first threshold in magnitude, the current-sensing signal being related to the first predetermined frequency. Additionally, the system controller is configured to, if the current-sensing signal related to the first predetermined frequency is determined to be larger than the first threshold in magnitude, generate at least the drive signal related to a second predetermined frequency, the second predetermined frequency being the same as or different from the first predetermined frequency, for a first period of time, maintain or change at least the drive signal, not in response to whether the current-sensing signal related to the second predetermined frequency is smaller than a second threshold in magnitude, and after the first period of time, determine whether the current-sensing signal related to the second predetermined frequency is smaller than the second threshold in magnitude. Moreover, the system controller is configured to, if the current-sensing signal related to the second predetermined frequency is determined to be smaller than the second threshold in magnitude throughout a second period of time, change the drive signal in order to turn off the one or more cold-cathode fluorescent lamps, wherein the second period of time begins no earlier than an end of the first period of time. For example, the method is implemented according to at least FIG. 4(A), FIG. 4(B), FIG. 5, and/or FIG. 7.

For example, some or all components of various embodiments of the present invention each are, individually and/or in combination with at least another component, implemented using one or more software components, one or more hardware components, and/or one or more combinations of software and hardware components. In another example, some or all components of various embodiments of the present invention each are, individually and/or in combination with at least another component, implemented in one or more circuits, such as one or more analog circuits and/or one or more digital circuits. In yet another example, various embodiments and/or examples of the present invention can be combined.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A method for driving one or more cold-cathode fluorescent lamps, the method comprising:

generating at least one drive signal associated with a signal frequency, the signal frequency being equal to a first predetermined frequency;

receiving a current-sensing signal, the current-sensing signal being associated with a lamp current for the one or more cold-cathode fluorescent lamps in response to at least the first predetermined frequency;

determining whether the current-sensing signal is larger than a first threshold in magnitude, the current-sensing signal being related to the first predetermined frequency;

if the current-sensing signal related to the first predetermined frequency is determined to be larger than the first threshold in magnitude at anytime during a first period of time, changing the signal frequency from the first predetermined frequency to a second predetermined frequency, the second predetermined frequency being different from the first predetermined frequency;

if the current-sensing signal related to the first predetermined frequency is determined to be smaller than the first threshold in magnitude throughout the first period of time, changing the signal frequency from the first predetermined frequency to a third predetermined frequency, the third predetermined frequency being different from the first predetermined frequency;

generating at least the drive signal associated with the signal frequency, the signal frequency being equal to the third predetermined frequency;

receiving the current-sensing signal, the current-sensing signal being associated with the lamp current in response to at least the third predetermined frequency;

determining whether the current-sensing signal is larger than the first threshold in magnitude, the current-sensing signal being related to the third predetermined frequency; and if the current-sensing signal related to the third predetermined frequency is determined to be larger than the first threshold in magnitude at anytime during a second period of time, changing the signal frequency from the third predetermined frequency to the second predetermined frequency if the second predetermined frequency is different from the third predetermined frequency.

2. The method of claim 1, and further comprising:

if the current-sensing signal related to the first predetermined frequency is determined to be smaller than the first threshold in magnitude, determining whether a voltage-sensing signal related to the first predetermined frequency is larger than a second threshold in magnitude; and if the voltage-sensing signal is determined to be larger than the second threshold in magnitude, starting the first period of time.

3. The method of claim 1, and further comprising:

if the current-sensing signal related to the first predetermined frequency is determined to be smaller than the first threshold in magnitude, determining whether an amplified signal related to a duty cycle of the drive signal is larger than a third threshold in magnitude; and if the amplified signal is determined to be larger than the third threshold in magnitude, starting the first period of time.

4. The method of claim 1 wherein if the current-sensing signal related to the third predetermined frequency is determined to be smaller than the first threshold in magnitude throughout the second period of time, changing the drive signal.

5. The method of claim 4 wherein the process for changing the drive signal includes changing the drive signal to remain at a single logic level.

6. The method of claim 1 wherein the first predetermined frequency is larger than the second predetermined frequency in magnitude.

7. The method of claim 1 wherein the first predetermined frequency is larger than the third predetermined frequency in magnitude.

8. The method of claim 1 wherein the third predetermined frequency is the same as the second predetermined frequency.

9. The method of claim 1 wherein the third predetermined frequency is different from the second predetermined frequency.

10. A method for driving one or more cold-cathode fluorescent lamps, the method comprising:

generating at least one drive signal associated with a signal frequency, the signal frequency being equal to a first predetermined frequency;

receiving a current-sensing signal, the current-sensing signal being associated with a lamp current for the one or more cold-cathode fluorescent lamps in response to at least the first predetermined frequency;

determining whether the current-sensing signal is larger than a first threshold in magnitude, the current-sensing signal being related to the first predetermined frequency;

if the current-sensing signal related to the first predetermined frequency is determined to be larger than the first threshold in magnitude, generating at least the drive signal related to a second predetermined frequency, the second predetermined frequency being the same as or different from the first predetermined frequency;

for a first period of time, maintaining or changing at least the drive signal, not in response to whether the current-sensing signal related to the second predetermined frequency is smaller than a second threshold in magnitude;

after the first period of time, determining whether the current-sensing signal related to the second predetermined frequency is smaller than the second threshold in magnitude; and if the current-sensing signal related to the second predetermined frequency is determined to be smaller than the second threshold in magnitude throughout a second period of time, changing the drive signal in order to turn off the one or more cold-cathode fluorescent lamps, wherein the second period of time begins no earlier than an end of the first period of time.

11. The method of claim 10 wherein the first predetermined frequency is no less than the second predetermined frequency in magnitude.

12. The method of claim 10 wherein if the current-sensing signal related to the first predetermined frequency is determined to be larger than the first threshold in magnitude, changing the signal frequency from the first predetermined frequency to the second predetermined frequency, the second predetermined frequency being different from the first predetermined frequency.

13. The method of claim 12 wherein the first predetermined frequency is larger than the second predetermined frequency in magnitude.

14. A system for driving one or more cold-cathode fluorescent lamps, the system comprising:

a system controller configured to:

generate at least one drive signal associated with a signal frequency, the signal frequency being equal to a first predetermined frequency;

receive a current-sensing signal, the current-sensing signal being associated with a lamp current for the one or more cold-cathode fluorescent lamps in response to at least the first predetermined frequency;

determine whether the current-sensing signal is larger than a first threshold in magnitude, the current-sensing signal being related to the first predetermined frequency;

if the current-sensing signal related to the first predetermined frequency is determined to be larger than the first threshold in magnitude at anytime during a first period of time, change the signal frequency from the first predetermined frequency to a second predetermined frequency, the second predetermined frequency being different from the first predetermined frequency;

if the current-sensing signal related to the first predetermined frequency is determined to be smaller than the first threshold in magnitude throughout the first period of time, change the signal frequency from the first predetermined frequency to a third predetermined frequency, the third predetermined frequency being different from the first predetermined frequency;

generate at least the drive signal associated with the signal frequency, the signal frequency being equal to the third predetermined frequency;

receive the current-sensing signal, the current-sensing signal being associated with the lamp current in response to at least the third predetermined frequency;

determine whether the current-sensing signal is larger than the first threshold in magnitude, the current-sensing signal being related to the third predetermined frequency; and if the current-sensing signal related to the third predetermined frequency is determined to be larger than the first threshold in magnitude at anytime during a second period of time, change the signal frequency from the third predetermined frequency to the second predetermined frequency if the second predetermined frequency is different from the third predetermined frequency.

15. The system of claim 14 wherein the first predetermined frequency is larger than the second predetermined frequency in magnitude.

16. The system of claim 14 wherein the first predetermined frequency is larger than the third predetermined frequency in magnitude.

17. The system of claim 14 wherein the third predetermined frequency is the same as the second predetermined frequency.

18. The system of claim 14 wherein the third predetermined frequency is different from the second predetermined frequency.

19. A system for driving one or more cold-cathode fluorescent lamps, the system comprising:

a system controller configured to:

generate at least one drive signal associated with a signal frequency, the signal frequency being equal to a first predetermined frequency;

receive a current-sensing signal, the current-sensing signal being associated with a lamp current for the one or more cold-cathode fluorescent lamps in response to at least the first predetermined frequency;

determine whether the current-sensing signal is larger than a first threshold in magnitude, the current-sensing signal being related to the first predetermined frequency;

if the current-sensing signal related to the first predetermined frequency is determined to be larger than the first threshold in magnitude, generate at least the drive signal related to a second predetermined frequency, the second predetermined frequency being the same as or different from the first predetermined frequency;

for a first period of time, maintain or change at least the drive signal, not in response to whether the current-sensing signal related to the second predetermined frequency is smaller than a second threshold in magnitude;

after the first period of time, determine whether the current-sensing signal related to the second predetermined frequency is smaller than the second threshold in magnitude; and if the current-sensing signal related to the second predetermined frequency is determined to be smaller than the second threshold in magnitude throughout a second period of time, change the drive signal in order to turn off the one or more cold-cathode fluorescent lamps, wherein the second period of time begins no earlier than an end of the first period of time.

20. The system of claim 19 wherein the first predetermined frequency is no less than the second predetermined frequency in magnitude.

* * * * *